US005924428A

United States Patent [19]

Song

[11] Patent Number: 5,924,428

[45] Date of Patent: Jul. 20, 1999

[54] NAIL POLISH MASKING DEVICE

[76] Inventor: Betty W. Song, 539 E. Smith Ave., Bloomington, Ind. 47401

[21] Appl. No.: 09/106,569

[22] Filed: Jun. 29, 1998

[51] Int. Cl.[6] ..... A45D 29/00; A45D 29/18

[52] U.S. Cl. ..... 132/285; 132/73; 132/73.5

[58] Field of Search ..... 132/285, 73, 73.5

[56] References Cited

U.S. PATENT DOCUMENTS

| | | | |
|---|---|---|---|
| 2,180,519 | 11/1939 | Hamilton et al. | 132/73 |
| 2,262,977 | 11/1941 | Vasil | 132/73 |
| 2,283,703 | 5/1942 | Stedman | 132/73 |
| 2,485,384 | 10/1949 | Klein | 132/73 |
| 4,172,461 | 10/1979 | Pangburn | 132/73 |
| 5,540,243 | 7/1996 | Simonton | 132/73 |
| 5,577,521 | 11/1996 | Neitlich | 132/285 |
| 5,699,816 | 12/1997 | Banes et al. | 132/285 |
| 5,743,277 | 4/1998 | Moreshead | 132/200 |

*Primary Examiner*—John J. Wilson
*Assistant Examiner*—Trang Doan
*Attorney, Agent, or Firm*—Woodard, Emhardt, Naughton, Moriarty & McNett

[57] ABSTRACT

The present invention contemplates a masking device utilized during the application of nail polish to a fingernail. In one embodiment, the masking device includes a clamp having a first finger gripping portion and a second finger-gripping portion. A flexible shield portion is connected to the clamp and extends distally therefrom and conforms to the shape of a finger so as to cover a proximal portion of the fingernail. The shield portion includes a distal edge defining either a curved or straight line across the fingernail.

5 Claims, 3 Drawing Sheets

NAIL POLISH MASKING DEVICE

BACKGROUND OF THE INVENTION

The present invention relates generally to an apparatus for use in giving a person a french manicure. More particularly, in one embodiment, a flexible mask is clamped to the finger for preventing the seepage of nail polish to the masked portion of the fingernail. Although the present invention was developed for use in the care of fingernails, certain applications may be outside this field.

The covering of fingernails with nail polish is well known. One of the methods used to care for fingernails is a french manicure. A french manicure accentuates the ends of the fingernails by applying an opaque polish (usually white) to the tip of the nail. The conventional french manicure may be applied either straight across the nail or curved in a manner that follows the end of the fingernail. Thereafter, a different color nail polish is typically applied over all or a portion of the opaque polish.

One method to obtain a french manicure is to employ a highly skilled manicurist. A highly skilled manicurist is required because not all manicurists are capable of applying the polish along a uniform line at the exact location. Even the most expensive manicures applied by professional manicurists do not always produce uniform results among each of the fingernails. The result is that all of the fingers are not uniform with each other, and even the shape of each individual finger is unsatisfactory. It may then become necessary to remove the polish at the tip, and apply a new french manicure or a conventional manicure.

In an attempt to address some of these problems, masking devices have been developed over the years to assist in the uniform application of nail polish, with a particular focus on the problems associated with french manicures. However, many masking devices have not been effective at addressing the problems known in the art, and in certain situations have presented additional problems. One common limitation is that the masking devices may not be readily adaptable to the shape of the finger. As a result, the nail polish is able to run under the mask and create a non-uniform appearance on the nail when the mask is removed. Another common limitation is that the masks do not readily conform to the differences between fingers in terms of the size and geometric profile, thereby limiting the ability to reuse the mask. This adds to the expense of preparing nails with a manicure. Further, many of the prior art masks are clumsy and awkward to handle, particularly for those who are self-applying the manicure. These are just a couple of the limitations associated with existing masking devices.

Although the prior techniques utilizing masks for use in giving a french manicure are steps in the right direction, the need for additional improvement still remains. The present invention satisfies this need in a novel and unobvious way.

SUMMARY OF THE INVENTION

In accordance with one aspect of the present invention, a device for masking a portion of a fingernail of a finger is disclosed. The device includes a side-loaded clamp configured to pass over a side of and grip the finger. A flexible shield portion is engaged to and extends from the clamp to cover a portion of the fingernail when the clamp is gripped to the finger.

In accordance with another aspect of the present invention, a fingernail-masking device is disclosed. The device includes a clamp that grips the finger. A first shield portion is engaged to and extends from the clamp in a first direction, and a second shield portion is engaged to the clamp and extends from the clamp in a second direction. The first and second shield portions are configured to alternately cover a portion of the fingernail.

In yet another aspect of the present invention, a method for applying fingernail polish to a fingernail is disclosed. The method comprises: providing a side-loading clamp with at least one flexible shield portion extending therefrom; positioning the clamp over a side of the finger so the shield portion covers a proximal portion of the fingernail; applying nail polish to a distal portion of the fingernail; and removing the clamp.

One object of the present invention is to provide an improved nail polish masking device. This object, among others, will be more apparent from the following description of the preferred embodiment.

DESCRIPTION OF THE PREFERRED EMBODIMENTS

Figure 1:
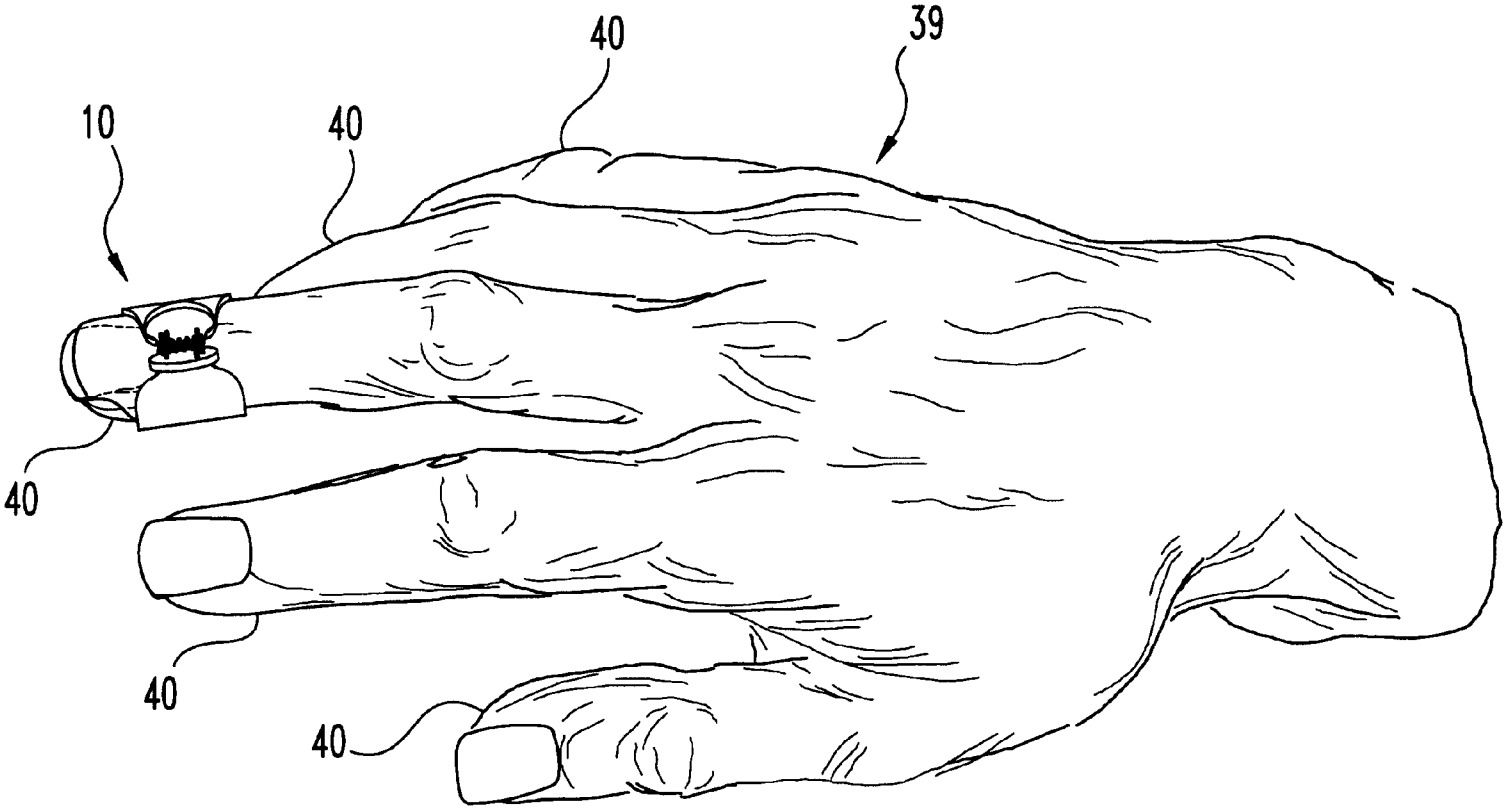
FIG. 1 is a perspective view of a hand with one embodiment of the masking device of the present invention engaged to a finger thereof.

For the purposes of promoting and understanding of the principals of the invention, reference will now be made to the embodiment illustrated in the drawings and specific language will be used to describe the same. It will nevertheless be understood that no limitation of the scope of the invention is thereby intended. Such alterations and further modifications in the illustrated device, and such further applications of the principals of the invention as illustrated therein being contemplated as would normally occur to one skilled in the art to which the invention relates.

With reference to FIG. 1, there is illustrated therein a human hand 39 having one embodiment of the masking device 10 engaged to a finger 40 thereof. Masking device 10 includes a coupling apparatus for removably coupling the device 10 to any one of the fingers 40 of a person receiving a manicure. It should be understood that the masking device 10 may be engaged to any one of the fingers 40 of hand 39. Additionally, the masking device 10 may be used on either hand.

Figure 2:
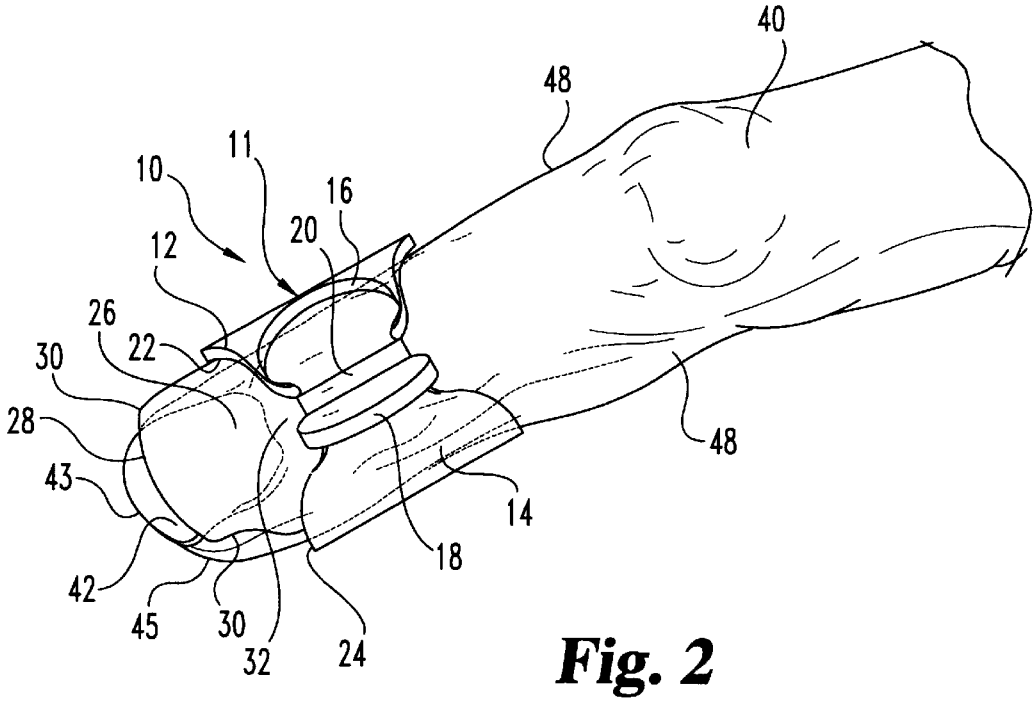
FIG. 2 is an enlarged perspective view of the masking device and engaged finger of FIG. 1.

For purposes of clarity, the masking device 10 will now be further described by referring to FIG. 2, an enlarged perspective view of the engaged masking device 10 of FIG. 1. In a preferred embodiment, the coupling apparatus of masking device 10 is defined by a side-loading clamp 11 having a first finger gripping portion 12 pivotally engaged to a second finger gripping portion 14 by hinge 20. First finger gripping portion 12 defines a first interior surface 22, and second finger gripping portion 14 defines a second interior surface 24. In a preferred embodiment, first and second interior surfaces 22, 24 are shaped to substantially conform to the shape of the side portions 48 of finger 40. It should be understood that side portions 48 may include any part of the circumference of the finger, including, but not limited to, the top portion, bottom portion, and lateral portions of the finger. However, side portion 48 does not include end 45 of finger 40. Alternate embodiments contemplate other configurations for interior surfaces 22, 24 so long as masking device 10 may be placed securely on the finger 40.

First and second gripping portions 12, 14 further include a first lever arm 16 and second lever arm 18, respectively, extending therefrom. The lever arms 16, 18 are configured to be operable by manipulating the fingers to rotate gripping portions 12, 14 apart about the hinge 20. When the gripping portions 12, 14 are separated a sufficient distance, the gripping portions 12, 14 may be placed around the side of finger 40 so that interior surfaces 22, 24 contact the side portions 48. Lever arms 16, 18 are then released, and the hinge 20 biases the gripping portions 12, 14 to a closed position such that masking device 10 is securely positioned on the finger 40.

A shield portion 26 is connected to the coupling apparatus, and in the preferred embodiment is connected to clamp 11. Shield portion 26 extends distally from clamp 11 to shield a proximal portion extending from the cuticle to the tip 43 of nail 42. Shield portion 26 includes a proximal portion 32 engaged to clamp 11. The coupling of the proximal portion 32 to the clamp 11 is believed within the skill of one of ordinary skill in the art. Methods of coupling include bonding the proximal portion 32 to one or both of the gripping portions 12, 14 of clamp 11; affixing the proximal portion 32 to clamp 11 via a mechanical connection, such as a pin or rivet extending through the gripping portion 12 and/or 14 and shield portion 26; and integrally molding the proximal portion 32 with clamp 11. These examples should not be considered limiting, but rather illustrative of the various means available for connecting shield portion 26 to clamp 11.

Shield portion 26 includes distal edge 28 and lateral edges 30. Lateral edges 30 are configured to extend to the side portions 48 of finger 40 to shield the proximal portion of nail 42 from polish. Distal edge 28 is configured to expose distal tip 43 of nail 42.

Figure 3:
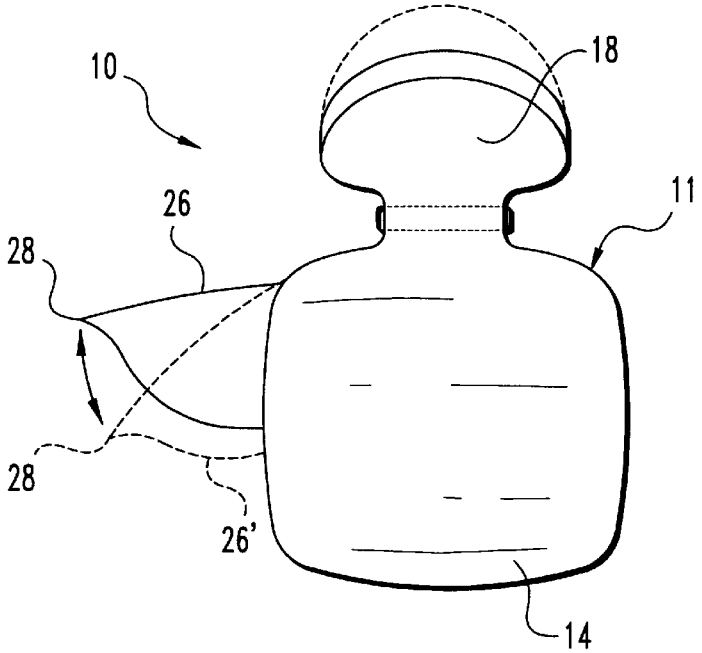
FIG. 3 is a side elevational view of the masking device of FIG. 1.

Referring now to FIG. 3, a side elevational view of masking device 10 is shown without a finger. In a preferred embodiment, shield portion 26 is coupled to clamp 11 such that shield portion 26 is biased downward in a first position, as indicated by the dashed outline 26' of shield portion 26, when masking device 10 is unengaged from finger 40. When the masking device 10 is engaged to finger 40, shield portion 26 is moved to a second position, as indicated by the solid outline of shield portion 26. When in the second position, shield portion 26 is normally biased downward towards the nail 42 such that the distal edge 28 provides pressure against nail 42. In one embodiment, only distal edge 28 contacts nail 42. The pressure between distal edge 28 and nail 42 assists shield portion 26 in preventing seepage of polish between shield portion 26 and nail 42.

Figure 4:
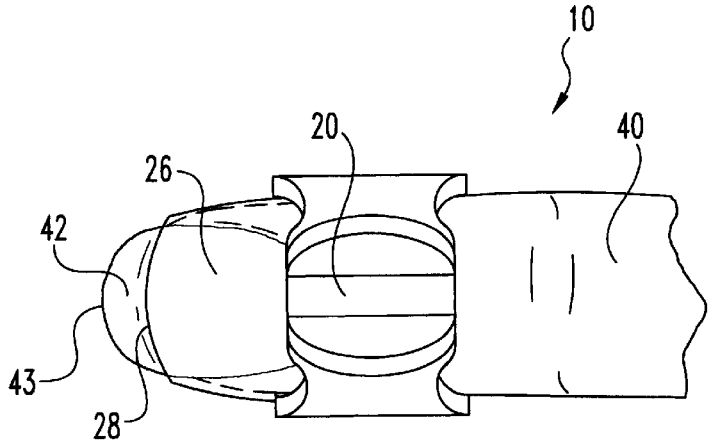
FIG. 4 is an enlarged top plan view of the masking device and engaged finger of FIG. 1.

With reference to FIG. 4, there is illustrated masking device 10 coupled to a finger 40 so as to present the distal tip 43 for receiving polish. In one embodiment, the distal edge 28 of shield portion 26 defines a curved profile, and in a preferred embodiment is designed to substantially parallel a normal/typical curvature of tip 43.

Figure 5:
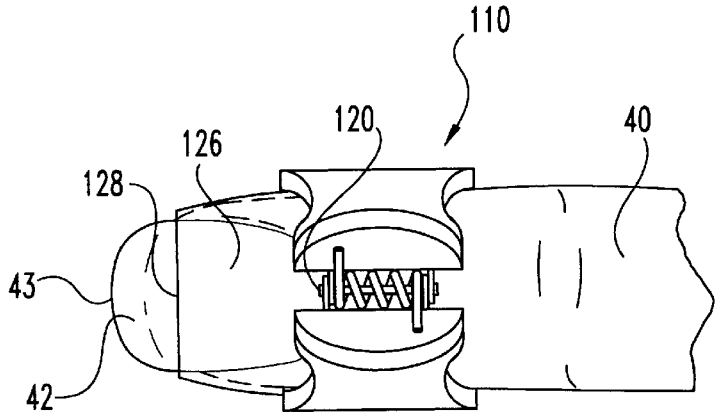
FIG. 5 is a top plan view of an alternate embodiment of the masking device of FIG. 1.

With reference to FIG. 5, there is illustrated an alternate mask device 110 which is substantially the same as mask 10. All features are alike except that the distal edge 128 of shield portion 126 is substantially straight such that the polish on tip 43 defines a substantially half-circle shape. The present invention additionally contemplates other configurations of shield portion 26 and distal edge 28 that allow other patterns of nail polish to be applied to nail 42 as would occur to one skilled in the art.

Figure 6:
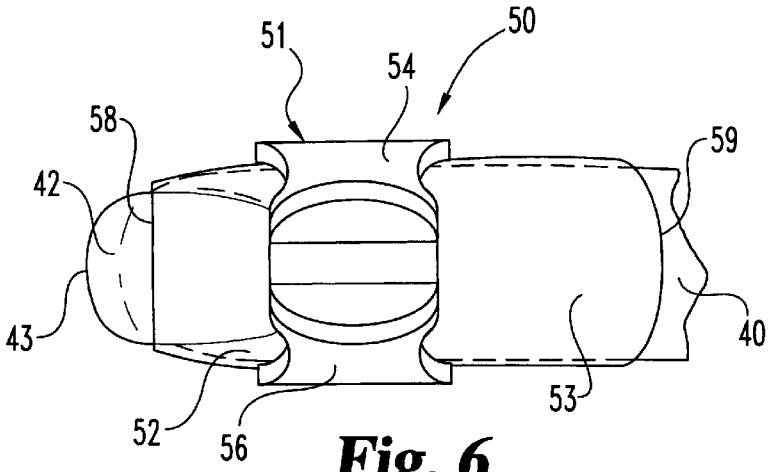
FIG. 6 is a perspective view of an alternate embodiment-masking device of the present invention engaged to a finger.

With reference to FIG. 6, an alternate embodiment of the masking device is illustrated and designated generally at 50. Masking device 50 includes clamp 51 substantially similar to clamp 11 of FIG. 2. Clamp 51 defines gripping portions 54, 56. The device 50 also includes a first shield portion 52 and a second shield portion 53 engaged to and extending from clamp 51 in opposite directions. First shield portion 52 and second shield portion 53 may be formed from a single piece of flexible material, or each may be formed from a separate piece of flexible material. This alternate embodiment allows the same masking device 50 to be used to provide alternate configurations of nail polish. As illustrated, first shield portion 52 has a curved distal edge 58, and second shield portion 53 has a straight distal edge 59. The masking device 50 may be rotated 180 degrees before being placed on the finger to obtain the desired shape of nail polish on the nail. Alternatively, the distal edges 58, 59 of shield portions 52, 53 may define substantially identical-shaped ends 58, 59.

Preferably, shield portions 26, 52, 53 are made from a flexible material, such as rubber, elastomer, teflon, plasticized vinyl, or the like, that conforms to the shape of any finger over which it is placed. The material should be durable so the masking device 10 may be cleaned and reused anytime. The material should also be able to withstand repeated applications of nail polish and nail polish remover without losing its flexibility. Additionally, the material should be impermeable to prevent nail polish from seeping therethrough.

Finger gripping portions 12, 14, 54, 56 may be made of any suitable material, such as plastic or metal, and may be molded, formed, or machined into the desired shape. Hinge 20 can be a resilient hinge integrally formed and molded with the gripping portions 12, 14 as shown in FIGS. 2 and 4. Alternatively, as shown in FIG. 5, hinge 120 may include a pin pivotably connecting the gripping portions of the clamp and a spring to bias gripping portions to a closed position. In any event, the present invention contemplates that hinge 20, 120 is operable to pivotably couple gripping portions 12, 14 and resiliently bias the gripping portions 12, 14 to a closed position.

While the invention has been illustrated and described in detail and the drawings and foregoing description, the same is to be considered as illustrative and not restrictive in character, it being understood that only the preferred embodiments has been shown and described and that all changes and modifications that come within the spirit of the invention are desired to be protected.

What is claimed is:

1. A method for applying fingernail polish to a fingernail of a finger, the method comprising:

providing a side-loading clamp having a first flexible shield portion extending therefrom, and a second flexible shield portion extending from the clamp opposite the first flexible shield portion;

selecting the desired shield portion from one of the first shield portion and the second shield portion;

rotating the clamp accordingly after the clamp is provided;

positioning the clamp over a side of the finger such that the desired shield portion covers a proximal portion of the fingernail;

applying nail polish to a distal portion of the fingernail; and removing the clamp.

2. The method of claim 1, wherein positioning the clamp, applying the nail polish, and removing the clamp are repeated for each finger.

3. The method of claim 2, wherein one of the shield portions provided defines a curved edge and the other shield portion defines a straight edge.

4. The method of claim 1, wherein one of the flexible shield portions defines a curved edge.

5. The method of claim 1, wherein one of the flexible shield portions defines a straight edge.

* * * * *